United States Patent [19]

Takeshima et al.

[11] Patent Number: 4,891,867

[45] Date of Patent: Jan. 9, 1990

[54] SLIDE FASTENER

[75] Inventors: Kiyoshi Takeshima; Ryukichi Murai, both of Toyama, Japan

[73] Assignee: Yoshida Kogyo K. K., Tokyo, Japan

[21] Appl. No.: 435,927

[22] Filed: Oct. 22, 1982

[30] Foreign Application Priority Data

Oct. 28, 1981 [JP] Japan ..... 56-172608

[51] Int. Cl.[4] ..... A44B 19/30

[52] U.S. Cl. ..... 24/408; 24/403

[58] Field of Search ..... 24/403, 408, 413, 414

[56] References Cited

U.S. PATENT DOCUMENTS

| | | | |
|---|---|---|---|
| 3,328,857 | 7/1967 | Burbank | 24/408 X |
| 3,736,628 | 6/1973 | Hansen | 24/413 X |
| 4,037,295 | 7/1977 | Rojahn | 24/413 |
| 4,080,691 | 3/1978 | Moertel | 24/408 |
| 4,140,157 | 2/1979 | Scott | 24/408 |
| 4,290,175 | 9/1981 | Moertel | 24/408 |
| 4,418,449 | 12/1983 | Heimberger | 24/408 |

FOREIGN PATENT DOCUMENTS

| | | | |
|---|---|---|---|
| 110207 | 12/1980 | Japan | 24/408 |
| 110208 | 12/1980 | Japan | 24/408 |

*Primary Examiner*—Peter A. Aschenbrenner

[57] ABSTRACT

A slide fastener comprising a fastener tape and a continuous synthetic resin fastener element row produced by extruding means having a series of cavities and secured to one side edge of the fastener tape by means of element securing threads is disclosed. The fastener element row includes a plurality of individual fastener elements each including an engaging head and upper and lower legs extending from the engaging head. The individual fastener elements are in series connected at regular spaces by upper and lower synthetic resin spacer means integrally formed with the fastener elements adjacent to the free ends of the legs. The spacer means has a minimum cross sectional area in the central portion thereof and the diameter gradually increases from the central portion toward and being connected to the opposing walls of adjacent fastener elements. The slide fastener further comprises connecting threads passing through the upper and lower legs of the plurality of connected fastener elements adjacent and parallel to the spacer means and anchored to the legs.

8 Claims, 5 Drawing Sheets

SLIDE FASTENER

BACKGROUND OF THE INVENTION

This invention relates to a slide fastener which includes a continuous fastener element row secured to one side edge of a fastener tape by means of weaving, knitting or sewing. The fastener element row is produced by extruding synthetic resin material into a series of connected molding cavities in the periphery of a rotary die wheel and then drawing the molded product out of the die wheel.

A synthetic resin fastener element row having a plurality of fastener elements in series connected by spacer means produced by means of an extruding means is useful because the individual fastener elements are regularly spaced from each other and the fastener element row having a long length can be obtained. For producing such a fastener element row, it has been proposed to extrude synthetic resin material in the form of a sheet by a die and then subject the molded product to a processing step such as punching or bending to thereby obtain a fastener element row including a plurality of individual fastener elements having engaging heads and upper and lower legs the free ends of which are connected together by portions of synthetic resin material. However, such a fastener element row has portions connecting between the individual fastener elements and having the thickness of the material sheet and an increased width because the fastener element row is produced by punching the material sheet and the fastener element row lacks in flexibility required for the same. Thus, the fastener element row is unsuitable as a product.

Therefore, study has been conducted with the aim to produce flexible fastener element rows and various proposals have been made. According to the art disclosed in U.S. Pat. No. 3,328,857, for example, the upper and lower legs of each individual fastener element are connected to the corresponding legs of adjacent fastener elements by means of a cord and the cords between the successive adjacent legs are alternately covered with synthetic resin to connect the legs together. Such synthetic resin coatings on the upper and lower legs of each fastener element are staggered. In the slide fastener of this type, since alternate cords are left uncoated and exposed, the exposed cords exhibit no load supporting function and thus, when high lateral pulling or bending force or thrust is applied to the slide fastener, separation extends from the bare cords through the legs to the coated cords and impairs the function of the slide fastener. In an extreme case, such separation damages the slide fastener. When the fastener element row is secured to the fastener tape, the element row can be secured to the tape by weaving; in such a case, threads constituting the tape are placed about the coated and uncoated portions. However, since the coated and uncoated portions have different load bearing capabilities, the individual fastener elements tend to incline to make it difficult to secure the fastener element to the tape with constant pitch.

In order to eliminate the above-mentioned disadvantages, the applicant proposed the slide fastener as disclosed in Japanese Patent Applications Nos. 188386/1980 and 186005/1980. In the slide fastener disclosed in these Japanese patent applications, synthetic resin spacer means are provided between adjacent fastener elements for resiliently bending together with the fastener elements and the spacer means are positioned in the position corresponding to the vertical axis of the fastener element row passing through the center of rotation of each of the fastener elements about which the element rotates as the slide fastener element row is opened and closed to thereby eliminate the above-mentioned disadvantages. More particularly, the slide fastener of these Japanese patent applications exhibits stabilized function with proper and smooth sliding resistance of the slider as the slide fastener is opened and closed.

As compared with the prior art slide fasteners, although the slide fastener of these Japanese patent applications is substantially improved with respect to thrust (vertical force acting concentrically on the element engaging portions of the slide fastener) strength and bending (force for bending the slide fastener in the longitudinal direction of the slide fastener) strength, the slide fastener is not satisfactory for use in connection with bags and trousers where substantial thrust and bending force act. In order to further improve the thrust and bending strength of a slide fastener, although it is known that the spacer means are preferably positioned adjacent to the free ends of the legs, (When thrust or bending force is applied to the fastener, the fastener elements positioned in the position where the peak of the thrust or bending deformation acts tend to widen the distance therebetween and at the same time, the engaging heads of such elements tend to rise up pushing the engaging heads of the adjacent elements away therefrom. At this time, if the distance from the engaging heads to the spacer means is long, the adjacent elements can move by a great distance maintaining their engaging relationship. And when the distance from the engaging heads to the spacer means is long, the elements easily deform elastically and resist disengagement.) When the spacer means are positioned adjacent to the free ends of the element legs as stated above, the spacer means are displaced from the neutral axis of the fastener element row and as a result, the degree of expansion and contraction of the spacer means increases as the fastener is opened and closed and the sliding resistance of the slider increases. And, as the fastener is frequently opened and closed, when the expansion and contraction of the spacer means increase as mentioned above, the spacer means become fatigued which causes the boundary between the spacer means and legs of the fastener element row to crack to thereby shorten the service life of the fastener.

SUMMARY OF THE INVENTION

With the above mentioned situation in mind, the object of the present invention is to provide a slide fastener including a continuous synthetic resin fastener element rows which have proper flexibility and smooth opening and closing function, which enjoys a long service life and which exhibits sufficient thrust and bending strength.

The present invention may be summarized as a slide fastener comprising a fastener tape and a continuous synthetic resin fastener element row produced by extruding means having a series of cavities and secured to one side edge of the fastener tape by means of element securing threads, the fastener element row including a plurality of individual fastener elements each including an engaging head and upper and lower legs extending from the engaging head, the individual fastener elements being in series connected at regular spaces by upper and lower synthetic resin spacer means integrally formed with the fastener elements adjacent to the free ends of the legs thereof, the spacer means having a minimum cross sectional area in the central portion thereof and gradually increasing the diameter from said central portion towards and being connected to the opposing walls of adjacent fastener elements, further comprising connecting threads passing through the upper and lower legs of the plurality of connected fastener elements adjacent and parallel to the spacer means and anchored to the legs.

DESCRIPTION OF THE PREFERRED EMBODIMENT

Figure 1:
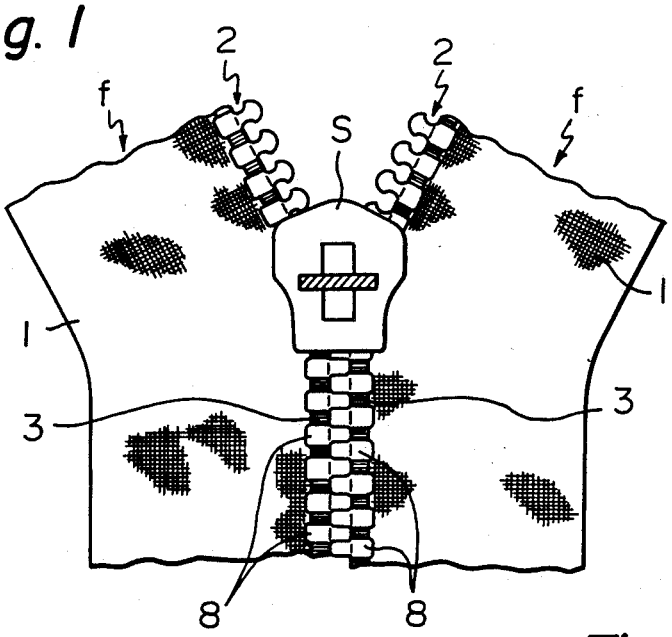
FIG. 1 is a fragmentary plan view of the first embodiment of the slide of the invention.
Figure 2:
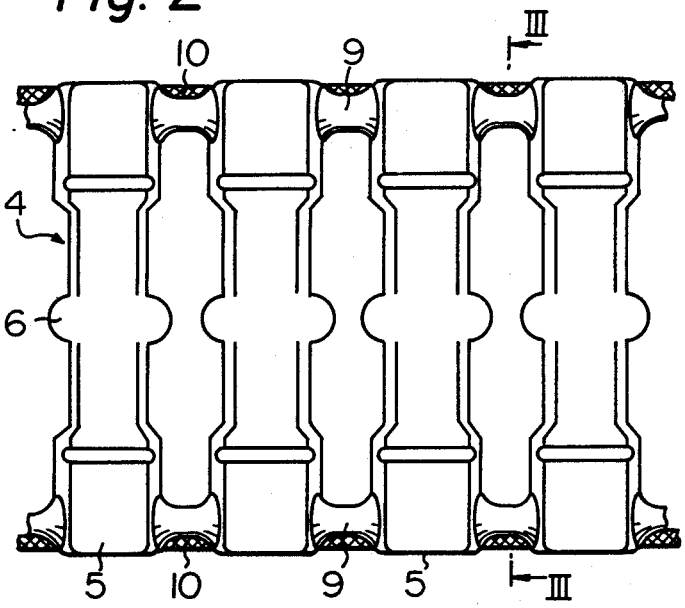
FIG. 2 is a plan view of the fastener element row blank.
Figure 3:
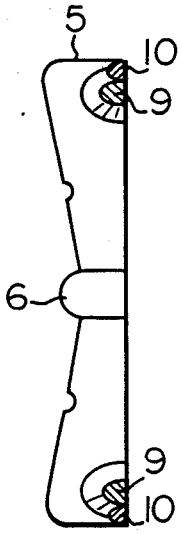
FIG. 3 is a cross sectional view taken along the line III—III and as seen in the arrow direction in FIG. 2.
Figure 4:
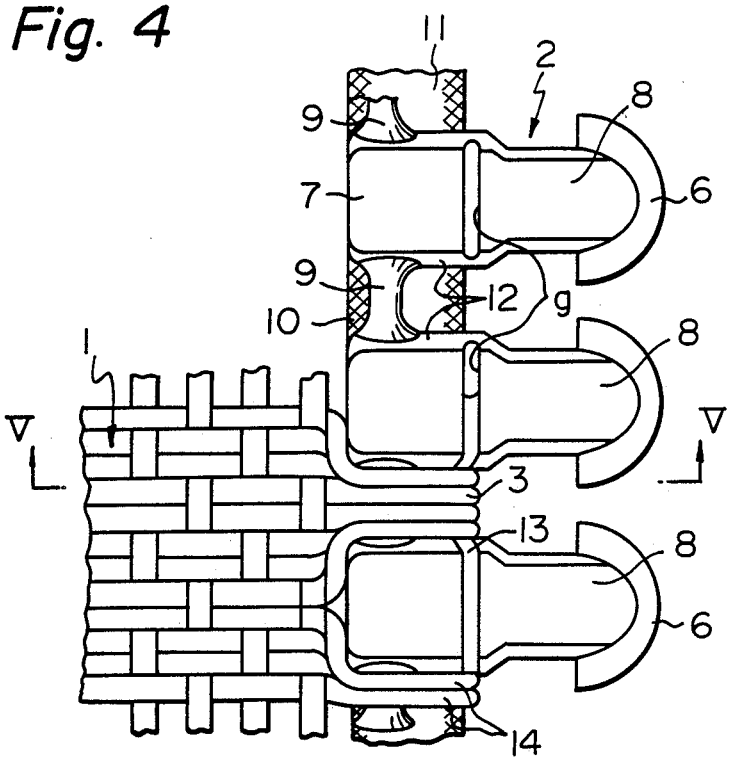
FIG. 4 is a fragmentary plan view on an enlarged scale of one of the stringers.
Figure 5:
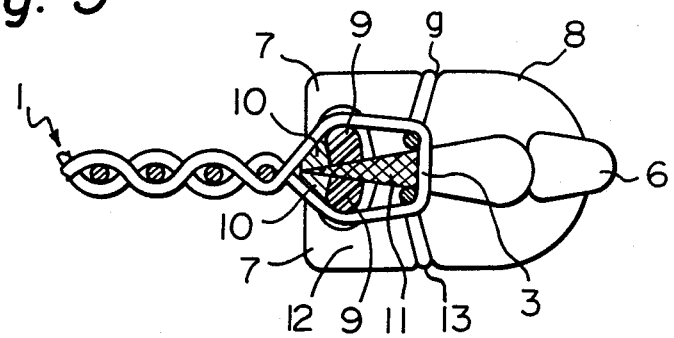
FIG. 5 is a cross sectional view taken along the line V—V and as seen in the arrow direction in FIG. 4.
Figure 6:
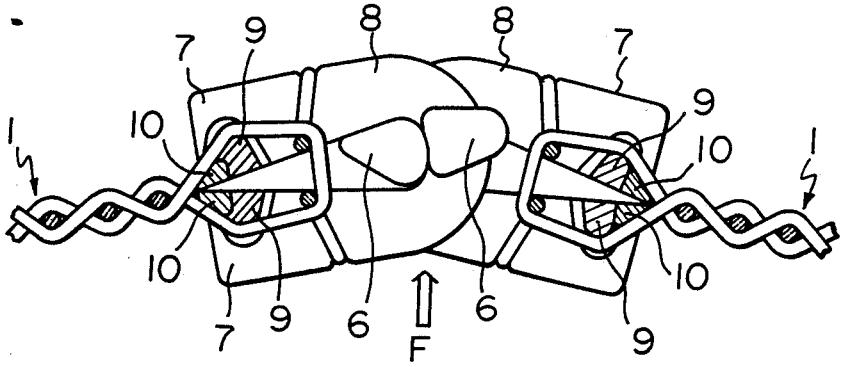
FIG. 6 is a cross sectional view showing the engagement between the fastener elements.
Figure 7:
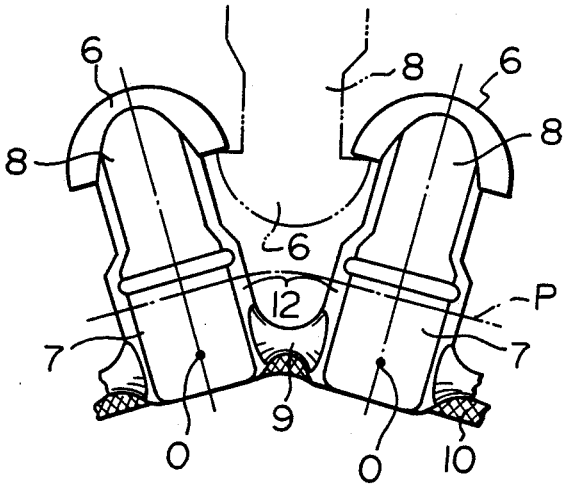
FIG. 7 is a plan view showing the rotational (rocking) mode of each fastener element.

The present invention will be now described referring to the accompanying drawings in which embodiments of the invention are illustrated. FIG. 1 shows a slide fastener having continuous fastener element rows of synthetic resin formed by the invention. In FIG. 1, f denotes a pair of left- and right-hand fastener stringers and s denotes a slider. The fastener stringer f comprises a fastener tape 1 having the continuous fastener element row 2 of synthetic resin secured thereto along one slide edge of the fastener tape by means of element securing threads 3. As more clearly shown in FIGS. 2 and 3, the synthetic resin fastener element row 2 has been produced by bending an extruded flat synthetic resin fastener element blank into a U-shaped configuration by a suitable bending means. For molding the fastener element blank 4, an extruding machine having a rotary die wheel (not shown) is employed and the die wheel is formed with a series of cavities corresponding to the individual fastener elements of the continuous fastener element blank 4. The individual fastener element blanks 5 are connected together by synthetic resin connector or spacer means 9 and connecting threads 10 are passed through the connected fastener element blanks in parallel to the spacer means 9. The continuous fastener element blank 4 is bent about the engaging heads of the fastener elements into the U-shaped configuration to provide individual fastener elements 8 as shown in FIGS. 4 and 5. Namely, each fastener element 8 comprises the engaging head 6 and a pair of upper and lower legs 7, 7 extending from the engaging head 6. The fastener elements 8 are in series connected by means of the synthetic resin spacer means 9 integrally formed therewith leaving regular spaces between the elements and the connecting threads 10, 10 are passed through the ends of the legs 7, 7 . . . of the elements 8, 8 . . . in parallel to the rows of the spacer means 9, 9 and anchored to the legs 7, 7 . . . The reference numeral 11 denotes core strings inserted in the fastener element rows 2, but the core strings may be eliminated. As shown, the synthetic resin spacer means 9, 9 . . . are positioned adjacent to the free ends of the fastener elements 8 to thereby impart sufficient thrust strength and bending strength to the slide fastener. That is, as more clearly shown in FIG. 6, when thrust or bending force F is applied to the slide fastener with the fastener elements 8 on the opposing fastener stringers f, f engaging each other, the respective engaging heads 6 at the tops of the fastener tend to rise up pushing away their mating adjacent engaging heads. At this time, the engaging heads 6 try to rotate about the centers of rotation O adjacent to the spacer means 9 as shown in FIG. 7, but the presence of the spacer means 9 adjacent to the leg free ends increases the radius of rotation of the engaging heads 6 to thereby allow the respective engaging heads 6 to move by a great distance maintaining the engaging relationship to their mating heads 6. And by the presence of the spacer means 9 adjacent to the leg free ends, even when force is applied to the engaging heads 6, the leg element portions between the heads 6 and spacer means 9 deform elastically to bear such force. On the other hand, the presence of the spacer means 9 adjacent to the free ends of the legs 7 causes the spacer means 9 to deviate from the neutral axis P of the fastener element row 2 and as a result, when the slide fastener is opened and closed, the degree of expansion and contraction of the spacer means 9 increases whereby the sliding resistance of the slider increases and the spacer means are easily subjected to fatigue fracture. In order to eliminate the disadvantages described just above, according to the present invention, as shown, the spacer means 9 has a minimum cross sectional area in the central portion thereof (including a cylindrical portion in the embodiment shown in FIGS. 2 through 7) so that the spacer means 9 can bend easily as the slide fastener is opened and closed and the sliding resistance of the slider is reduced. The spacer means 9 increases its cross sectional area from the central portion towards the opposing walls 12 of the adjacent fastener elements and the connecting threads 10 are passed through the elements adjacent and parallel to the spacer means 9 whereby the fatigue fracture of the spacer means adjacent to the opposing element walls is obviated. The connecting thread 10 is preferably positioned adjacent to the spacer means 9 as shown so that the center of rotation 0 of the fastener element 8 is positioned adjacent to the free ends of the element legs. And for the reason as will be described hereinafter, the connecting thread 10 is preferably positioned nearer to the free ends of the fastener element than the spacer means 9.

Furthermore, the fastener element row 2 is secured to the fastener tape 1 by means of the element securing threads 3 and in the embodiment as shown in FIGS. 4 and 5, the fastener element row is sewn to the fastener tape. In this embodiment, the fastener element row 2 is secured to the fastener tape 1 by means of weaving-in or by the engagement between warps 13 constituting the element securing threads 3 and wefts 14 engaging in grooves g formed in the upper and lower surfaces of the elements 8. The warps are beaten by a needle weaving machine (not shown) with two double picks per pitch of the element. Since the element pitch is determined by the synthetic resin spacer means 9, the present invention has the advantage that the number of warps beaten into the fastener element row 2 does not affect the element pitch directly. And when the connecting thread 10 is positioned nearer to the free ends of the element legs than the spacer means 9 as shown, when the warps are beaten in the pattern as shown in FIG. 5, the warps are tightened against the connecting threads 10 at the free ends of the element legs by the elasticity of the connecting threads 10 to thereby leave no clearance between the warp and connecting threads.

Figure 8:
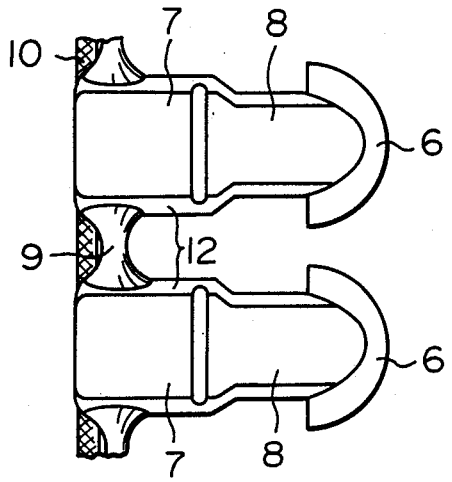
FIG. 8 is a plan view of the fastener element row showing a modified form of the spacer means.
Figure 9:
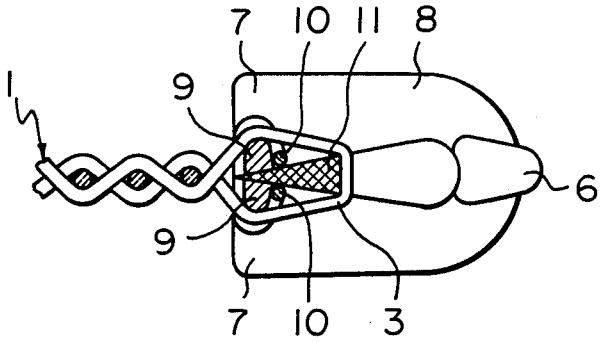
FIG. 9 is a cross sectional view showing a modified form of the fastener element row.
Figure 10:
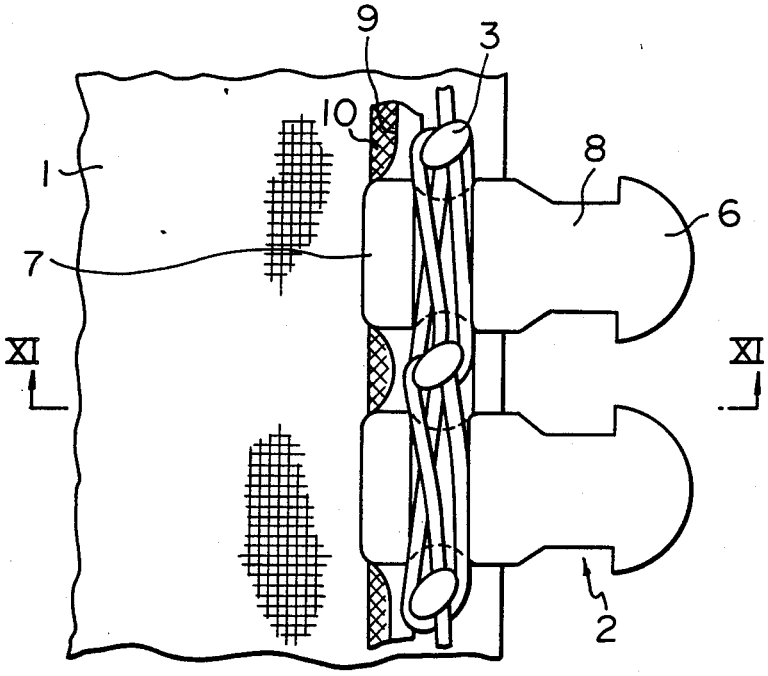
FIG. 10 is a fragmentary plan view on an enlarged scale of the other embodiment of the fattener stringer showing the sewing of the of fastener element row.
Figure 11:
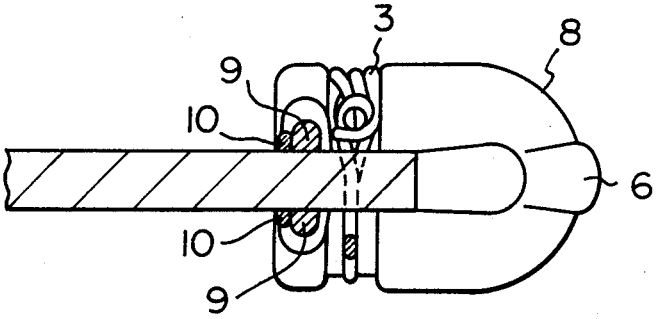
FIG. 11 is a cross sectional view taken along the line XI—XI and as seen in the arrow direction in FIG. 10.

FIG. 8 shows a modified form of the spacer means 9 and the spacer means 9 of FIG. 8 has a minimum cross sectional area in the central portion and directly increases its cross sectional area gradually towards the opposing walls 12 of the adjacent fastener elements. And in the arrangement as shown in FIG. 9, the connecting thread 10 is positioned nearer to the element head 6 than the spacer means 9. The modified embodiments of FIGS. 8 and 9 attain the same operative effects as those attainable by the preceding embodiment. FIGS. 10 and 11 show the instance in which the fastener element row is sewn to the fastener tape. In the embodiment as shown in FIGS. 10 and 11, the fastener element row 2 is sewn to the fastener tape 1 by sewing threads comprising the element securing threads 3 which are positioned between the synthetic resin spacer means 9 and connecting threads 10 and straddle the element leg 7 to fasten the legs. The fastener element row 2 is sewn to the fastener tape 1 by double-loop sewing, for example.

The connecting thread comprises a sewing thread or string. In the instance as shown, although one connecting thread 10 is passed through each of the upper and lower element leg 7, 7, a plurality of connecting threads may be employed extending in parallel to each other adjacent to the spacer means 9.

As described hereinabove, according to the present invention, since the spacer means interposed between the adjacent fastener elements are positioned adjacent to the free ends of the fastener element legs, sufficient thrust strength and bending strength can be provided. Furthermore, since similar spacer means and connecting threads are present in the upper and lower positions between the legs of the adjacent fastener elements and each of the upper and lower spacer means has a minimum cross sectional area in the central portion thereof and increases the cross sectional area towards the opposing walls of the adjacent fastener elements, the central portion of the spacer means having the minimum cross sectional area bends easily as the slide fastener is opened and closed whereby the sliding resistance of the slider can be reduced. And two upper and lower spacer means are provided between each two adjacent fastener elements and each of the spacer means increases its cross sectional area from the central portion towards the opposing walls of the adjacent fastener elements and the connecting threads are provided extending parallel to each other adjacent to the spacer means whereby the breaking of the spacer means is prevented and a sufficiently strong connection is obtained between the adjacent fastener elements. Thus, the entire slide fastener of the present invention has sufficient flexibility and strength, can be smoothly opened and closed with low sliding resistance of the slider and enjoys a long service life.

What is claimed is:

1. A slide fastener comprising a fastener tape and a continuous synthetic resin fastener element row produced by extruding means having a series of cavities and secured to one side edge of said fastener tape by means of element securing threads, said fastener element row including an engaging head and upper and lower legs extending from said engaging head, said individual fastener elements being connected in series at regular spaces by upper and lower synthetic resin spacer means integrally formed with the fastener elements adjacent to the free ends of the legs, said spacer means having a minimum cross sectional area in the central portion thereof and gradually increasing in diameter from said central portion towards and being connected to the opposing walls of adjacent fastener elements, further comprising connecting threads passing through said upper and lower legs of the plurality of connected fastener elements adjacent and parallel to said spacer means and anchored to said legs closer to said free ends of said legs than said spacer means.

2. The slide fastener as set forth in claim 1, in which each of said upper and lower spacer means includes a cylindrical portion having a minimum cross sectional area in the central portion thereof between adjacent fastener elements.

3. The slide fastener as set forth in claim 1, in which the cross sectional area of each of said upper and lower spacer means gradually increases from said central portion having the minimum cross sectional area towards the opposing sides of adjacent fastener elements.

4. The slide fastener as set forth in claim 1, in which said synthetic resin fastener element row is secured to said fastener tape by element securing threads extending about said synthetic resin spacer means and connecting threads.

5. The slide fastener as set forth in claim 1, in which said synthetic resin fastener element row is secured to said fastener tape by element securing threads positioned between said synthetic resin spacer means and connecting threads and straddling said legs of the fastener element.

6. The slide fastener as set forth in claim 1, in which said spacer means has a smooth connection to said opposing walls of adjacent fastener elements.

7. A slide fastener comprising:

a fastener tape;

a continuous synthetic resin fastener element row secured to one side edge of said fastener tape by means of element securing threads;

said fastener element row including an engaging head and upper and lower legs extending from said engaging head, said individual fastener elements being connected in series at regular spaces by upper and lower synthetic resin spacer means integrally formed with the fastener elements adjacent to the free ends of the legs;

said spacer means having a rounded surface and a minimum cross-sectional area in the central portion thereof gradually increasing in diameter from said central portion towards and being connected to the opposing walls of adjacent fastener elements; and comprising connecting threads passing through said upper and lower legs of the plurality of connected fastener elements adjacent and parallel to said spacer means and anchored to said legs closer to said free ends of said legs than said spacer means.

8. A slide fastener comprising:

a fastener tape;

a continuous synthetic resin fastener element row secured to one side edge of said fastener tape by means of element securing threads;

said fastener element row including an engaging head and upper and lower legs extending from said engaging head, said individual fastener elements being connected in series at regular spaces by upper and lower synthetic resin spacer means integrally formed with the fastener elements adjacent to the free ends of the legs;

said upper and lower spacer means having a cylindrical portion having a minimum cross-sectional area in the central portion thereof gradually increasing in cross-sectional area from said central portion towards and being connected to the opposing walls of adjacent fastener elements; and connecting threads passing through said upper and lower legs of the plurality of connected fastener elements adjacent and parallel to said spacer means and anchored to said legs closer to said free ends of said legs than said spacer means.

* * * * *